US007984578B2

(12) United States Patent
Kabel

(10) Patent No.: US 7,984,578 B2
(45) Date of Patent: Jul. 26, 2011

(54) SHADOW BOX FRAME AND INSERT

(76) Inventor: Sonja Kabel, Garden City, ID (US)

( * ) Notice: Subject to any disclaimer, the term of this patent is extended or adjusted under 35 U.S.C. 154(b) by 410 days.

(21) Appl. No.: 12/329,465

(22) Filed: Dec. 5, 2008

(65) Prior Publication Data

US 2009/0145804 A1 Jun. 11, 2009

Related U.S. Application Data

(60) Provisional application No. 60/992,338, filed on Dec. 5, 2007.

(51) Int. Cl.
*A47G 1/06* (2006.01)

(52) U.S. Cl. ..... 40/765; 40/611.07; 40/611.08; 40/491

(58) Field of Classification Search ..... 40/721, 40/722, 723, 724, 732, 765, 766, 743, 661.01, 40/737, 611.06–611.09; 312/776, 283, 286, 312/290, 132.2, 114; 206/769, 771, 776; 446/149, 433, 446, 435
See application file for complete search history.

(56) References Cited

U.S. PATENT DOCUMENTS

| | | | | |
|---|---|---|---|---|
| 214,105 | A * | 4/1879 | Cole | 40/724 |
| 981,486 | A * | 1/1911 | Shaner | 312/139.2 |
| 2,785,490 | A | 1/1956 | Fabry | |
| 3,965,599 | A | 6/1976 | Ebner | |
| 4,244,303 | A | 1/1981 | Kurasik | |
| 4,261,122 | A | 4/1981 | LeVine | |
| 4,998,361 | A * | 3/1991 | Gordon | 40/721 |
| 5,075,991 | A | 12/1991 | Wenkman et al. | |
| 5,105,567 | A * | 4/1992 | Real | 40/765 |
| 5,118,171 | A | 6/1992 | Ortiz | |
| 5,141,300 | A | 8/1992 | Ciesla | |
| 5,661,918 | A | 9/1997 | Malcolm et al. | |
| 6,776,281 | B2 | 8/2004 | Ovadia | |
| 6,845,582 | B1 | 1/2005 | Ho et al. | |
| 6,868,630 | B2 | 3/2005 | Kim | |
| 7,028,425 | B2 | 4/2006 | Lasher | |
| 7,305,785 | B2 | 12/2007 | Sharp | |
| 2004/0111944 | A1 | 6/2004 | Gatt et al. | |
| 2008/0000125 | A1 * | 1/2008 | Chang | 40/723 |

* cited by examiner

*Primary Examiner* — Cassandra Davis
(74) *Attorney, Agent, or Firm* — Dykas & Shaver, LLP

(57) ABSTRACT

A shadow box is provided that is configured to display art objects wherein the shadow box has two chambers, the front chamber configured to display art objects whereas the second chamber is configured to house an insert that is configured to slide into and out of the shadow box as well as to display art objects.

20 Claims, 10 Drawing Sheets

SHADOW BOX FRAME AND INSERT

CROSS-REFERENCE TO RELATED APPLICATIONS

This application claims the priority date of the provisional application entitled Three Dimensional Shadow Box and Activity Center filed on Dec. 5, 2007, with application Ser. No. 60/992,338. The provisional application is herein incorporated by reference.

FIELD OF THE INVENTION

The invention generally relates to an apparatus for displaying objects, and more particularly to a shadow box and insert for displaying objects.

BACKGROUND OF THE INVENTION

A variety of devices are well known in the art for holding and displaying pictures and other objects. Generally shadow box frames are constructed of a box having a top, a bottom, a first sidewall, a second sidewall, a front and a back with the front generally being transparent. The shadow box is designed to hold and display three dimensional objects as well as photographs and other mementos. Shadow boxes are also well known in the art. A problem that can be associated with some of the shadow boxes includes a potential difficulty in easily accessing objects displayed within the shadow box. Additionally, shadow boxes may not optimize display potential if they only provide a single display case.

Accordingly, an object of the current invention is to provide a shadow box that has a compartment that is accessible for changing objects displayed on the interior of the shadow box.

A further object of the invention is to provide a shadow box with an insert to increase display and storage area.

Another object of the invention is to provide a shadow box with a front side comprised of a transparent material that is removable for access to the interior of the shadow box.

A further object of the invention is to provide a shadow box with a front side that is secured with a magnetic and/or mechanical means provides easy access to swapping out the display items within the shadow box.

Furthermore, an object of the invention is to provide a shadow box with an insert that slides into and out of the shadow box while not fully extending out of the shadow box.

SUMMARY OF THE INVENTION

A shadow box and insert has been provided that maximizes display space as well as facilitates access to the interior of the shadow box and the interior of the insert for access to objects being displayed in the shadow box or insert. Accordingly, a shadow box has been invented that comprises a box having a top, a bottom, a front, a back, a first sidewall, and a second sidewall. The front of the shadow box comprises at least one section; at least one of the sections comprises a transparent material. The top of the shadow box comprises at least one removable section configured to be removable to facilitate access to the interior of the box. After the top of the box is removed, the front of the box can subsequently be removed. The shadow box is generally divided into at least two chambers. At least two of these chambers comprise a front chamber and a back chamber. Additionally, in one embodiment the partition dividing the front chamber and the back chamber generally comprises a shadow box display material.

In one embodiment, the insert is configured to display art objects and comprises a front, a back, a top, a bottom, a first sidewall, and a second sidewall. The insert has at least one front section; at least one of the front sections of the insert comprises a transparent material. In one embodiment, the top of the insert is configured such that the top of the insert can be removed. Subsequently the front of the insert can be removed. This facilitates access to the interior chamber of the insert. In this manner the user of the shadow box can access the interior of the shadow box first chamber as well as materials displayed on the interior of the insert of the shadow box.

In another embodiment of the shadow box, the top of the insert as well as the top of the shadow box comprises a magnetic means to removably attach the at least one removable top section of the shadow box to the shadow box and the at least one removable top section of the top of the insert to the insert. This prevents the at least one removable section of the top of the insert and the at least one removable section at the top of the shadow box from easily falling off and prevents the front of the insert and the front of the shadow box from falling out as well.

Additionally, in an embodiment the shadow box and insert is configured to be mounted on a wall.

In a further embodiment, the shadow box has grooves on the interior of the first sidewall as well as the interior of the second sidewall for holding the front side of the shadow box in place. Additionally, in an embodiment the interior of the first sidewall, the interior of the second sidewall, and the interior of the base also have grooves for holding the front of the insert in place.

In another embodiment, the insert is configured such that the insert does not slide completely out of the shadow box. In one embodiment the insert comprises an L shape such that the insert is not able to fully extend out of the shadow box as the insert cannot pass the beyond the sidewalls of the shadow box. A magnetic or other mechanical system can also be provided that prevents the extension from extending fully out of the shadow box.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the present invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
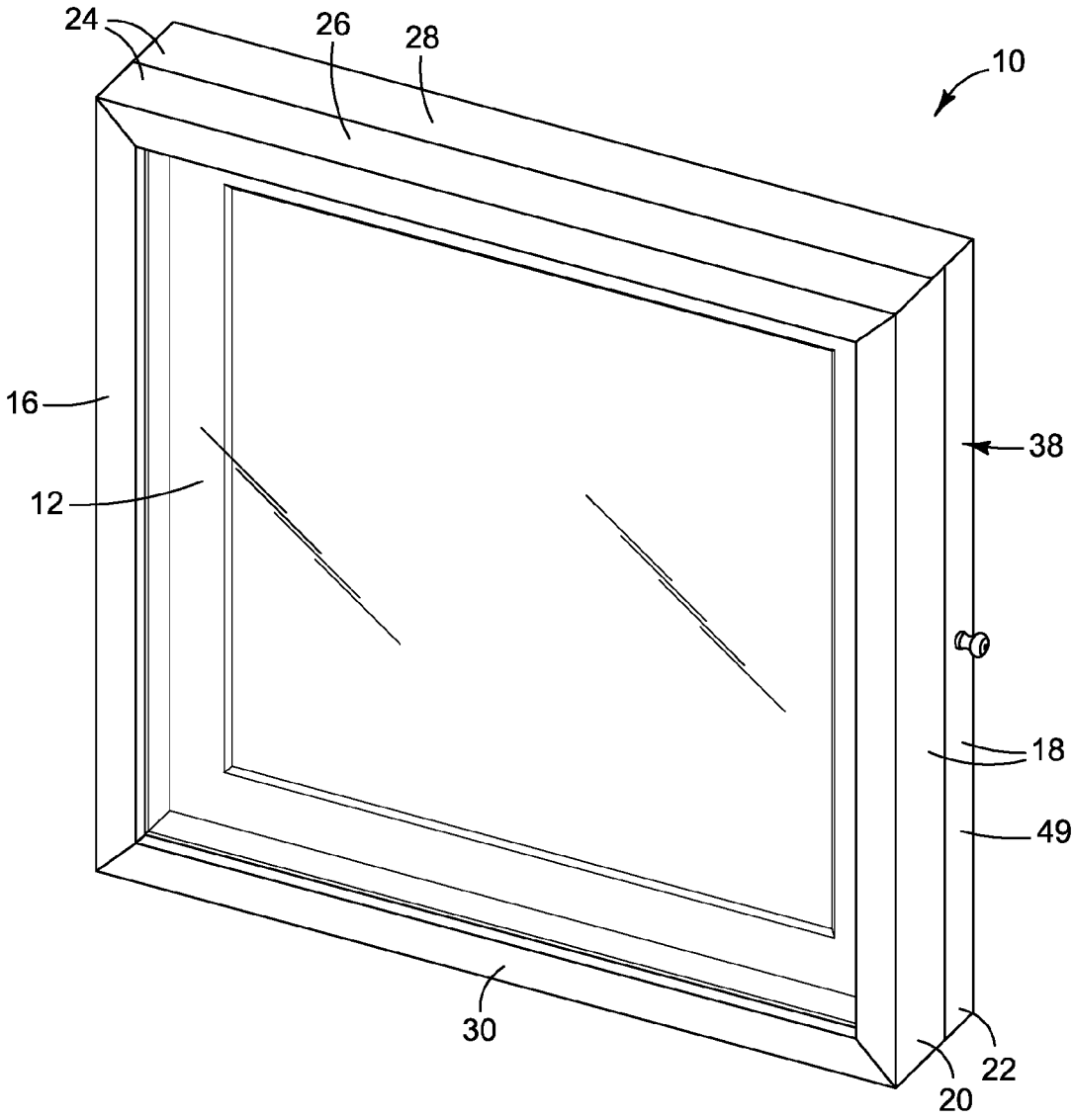
FIG. 1 is a perspective view of an embodiment of the shadow box with insert housed within the second chamber of the shadow box.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

A shadow box and insert is provided that maximizes display space by providing a shadow box with an insert as well as facilitates access to the interior of the shadow box and insert while providing for a decorative shadow box.

The shadow box and insert of the current invention attempt to solve potential difficulties encountered by previous inventions by maximizing display space as well as providing a system that allows for easy access to the interior of the shadow box and the interior of the insert for altering items to be displayed. The invention provides a novel shadow box with a removable transparent front as well as an insert having a removable transparent front for likely enhanced display capabilities when compared to other shadow boxes. Additionally, a system has been provided that generally prevents the transparent fronts of the shadow box and insert from inadvertently being removed.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

FIG. 1 illustrates a shadow box 10 with the insert housed in the shadow box. The shadow box 10 is typically used for scrapbooking. The shadow box 10 has a front side 12 that is generally comprised of a transparent material such as glass, plexiglass, plastic, or other transparent material in order for objects on the interior of the box to be seen by viewers outside of the box. The shadow box 10 has a back wall 14, a first side wall 16, a second side wall 18, a top of the box 24 that has a first member 26 and a second member 28, and a bottom of the box 30. The shadow box 10 can generally be constructed from any solid material such as but not limited to wood, plastic, pressed wood, Medium-density fibreboard, steel, etc. to and can be constructed to match any décor. The second side wall 18 is generally comprised of a first member 20 and a second member 22. The shadow box 10 is generally comprised of two chambers 32, 34. The two chambers 32, 34 are separated by a partition 36 within the shadow box 10. This creates a first chamber 32 and the second chamber 34 within the shadow box 10. The first chamber 32 is generally configured to house and display art objects such as mementos, photographs, trophies, artwork, drawings, and any other object a person may wish to display that would fit within the shadow box 10 whereas the second chamber 34 is generally configured to house an insert 38. The partition 36 between the first chamber 32 and second chamber 34 of the shadow box 10 is generally comprised of a scrapbooking or shadow box material that is designed for mounting objects and displaying objects. A knob 56 is generally provided on the insert 38 such that a person can grasp the knob 56 and pull the insert 38 out of the shadow box 10 or push the insert 38 into the shadow box 10. The insert 38 is generally configured such that the second member 22 of the second side wall 18 of the shadow box 10 also forms the second side wall 49 of the insert on which the knob 56 is located. In a further embodiment, the shadow box 10 is also configured to be mounted on a wall for decorative and display purposes. Archival safe material or material safe coating is typically to construct the shadow box 10.

Figure 2:
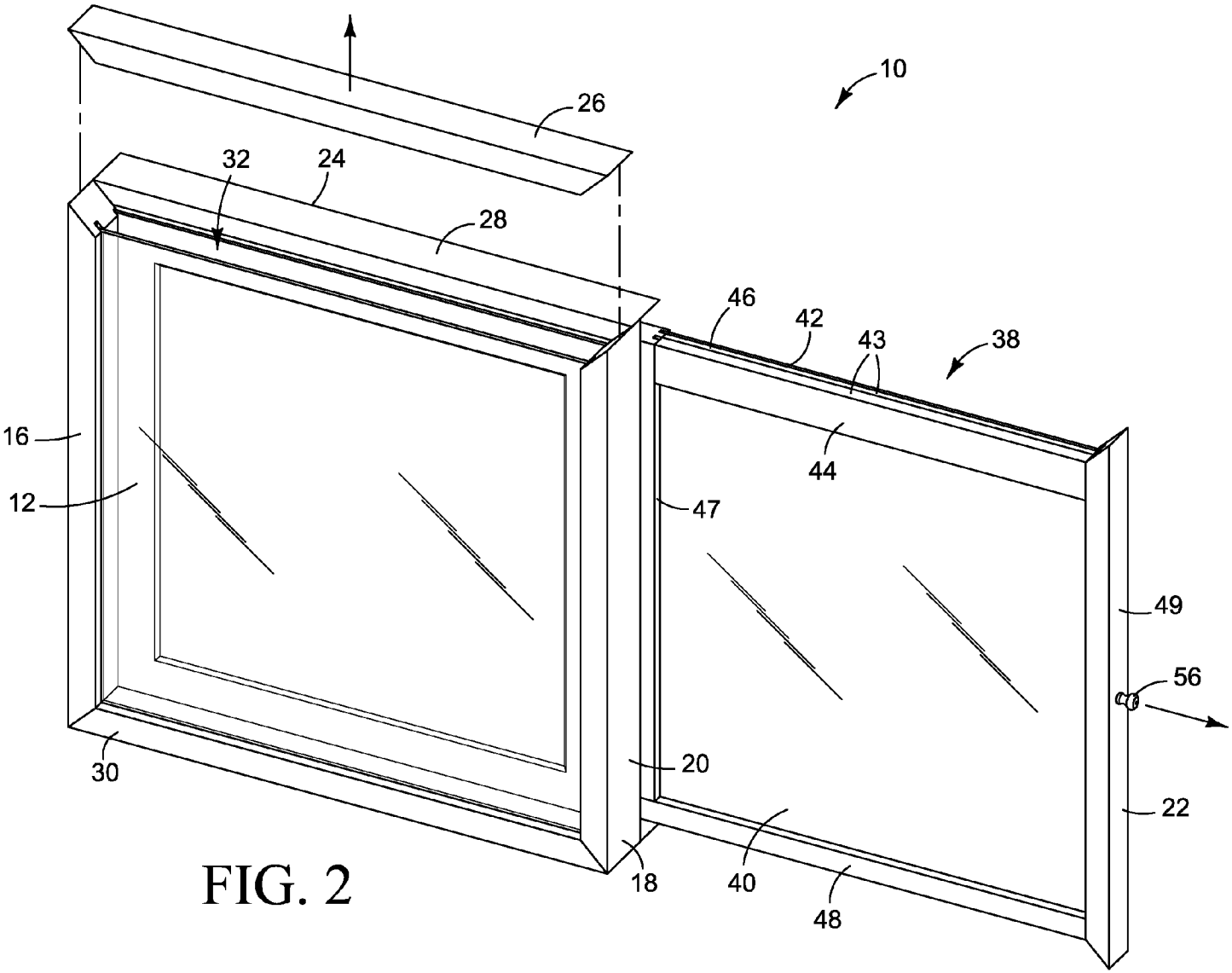
FIG. 2 is a partially exploded perspective of an embodiment of the insert extended out from the box with the first member of the top of the box detached from the box.

FIG. 2 generally shows the shadow box 10 with the insert 38 extended out from the shadow box 10. The insert 38 is generally comprised of an insert front 40 which is generally comprised of a transparent material such as glass, plexiglass, plastic, or other transparent material in order for objects on the interior 39 of the insert 38 to be seen by viewers from the outside of the insert 38. The insert 38 also has a back 42, an insert top 43 having a first member 44 and a second member 46, an insert bottom 48, a first sidewall 47 and a second sidewall 49. The insert 38 is generally configured to house objects or artwork for display including calendars, photographs, and any other artwork a user may want to display. Additionally, in one embodiment the insert has an extension 54 that prevents the insert 38 from fully sliding out of the second chamber 34 of the shadow box 34. In this embodiment the insert 38 with an extension 54 is configured in a generally L shape. In another embodiment, at least one member of both the top 43 of the insert 38 as well as the top 24 of the shadow box 10 are removable. In this manner the front 12 of the shadow box 10 as well as the front 40 of the insert 38 can be removed by sliding the insert front 40 and the shadow box front 12 in an upward direction to provide access to the first chamber 32 of the shadow box 10 as well as the chamber 39 of the insert 38. Furthermore, the first member 26 of the top 24 of the box 10 as well as the top 43 of the insert first member 44 are generally held in place by a connection means. The connection means as illustrated in FIG. 2 or other figures can embody a magnetic means 50, 52 as illustrated in FIG. 2, a mechanical means including, but not limited to, a hinge mechanism, a mortise and tenon, or any other mechanical means apparent to those with knowledge of the art. The magnetic means 50, 52 generally comprises series of magnets or other magnetic means embedded into opposing sides of the top 24 of the box 10 and the top 43 of the insert 38 as well as the two side walls 47, 49 of the insert 38 as well as the two side walls 16, 18 of the shadow box 10. Although these connectors 50, 52 generally comprise magnetic pieces, they can also comprise any connectors known to those having knowledge in the art.

Additionally, a magnetic means can also be provided in one embodiment of the present invention for preventing the insert 38 from sliding completely out of the second chamber 34 of the shadow box 10 and also to prevent the insert 38 from sagging when extended away from the shadow box 10 if the apparatus is mounted on a wall. In another embodiment in order to keep the front of the shadow box 12 as well as the front 40 of the insert 38 in place, grooves 60, 64 can be provided on the interior of the first chamber 32 of the shadow box 10 as well as on the interior 39 of the insert 38. Grooves 62 can also be provided on the interior of the shadow box for holding the partition 36 in place between the front chamber 32 of the shadow box 10 and the back chamber 34 of the shadow box. In yet a further embodiment the insert 10 can comprise a material for display a calendar on such as a tack board without a transparent front.

Figure 3:
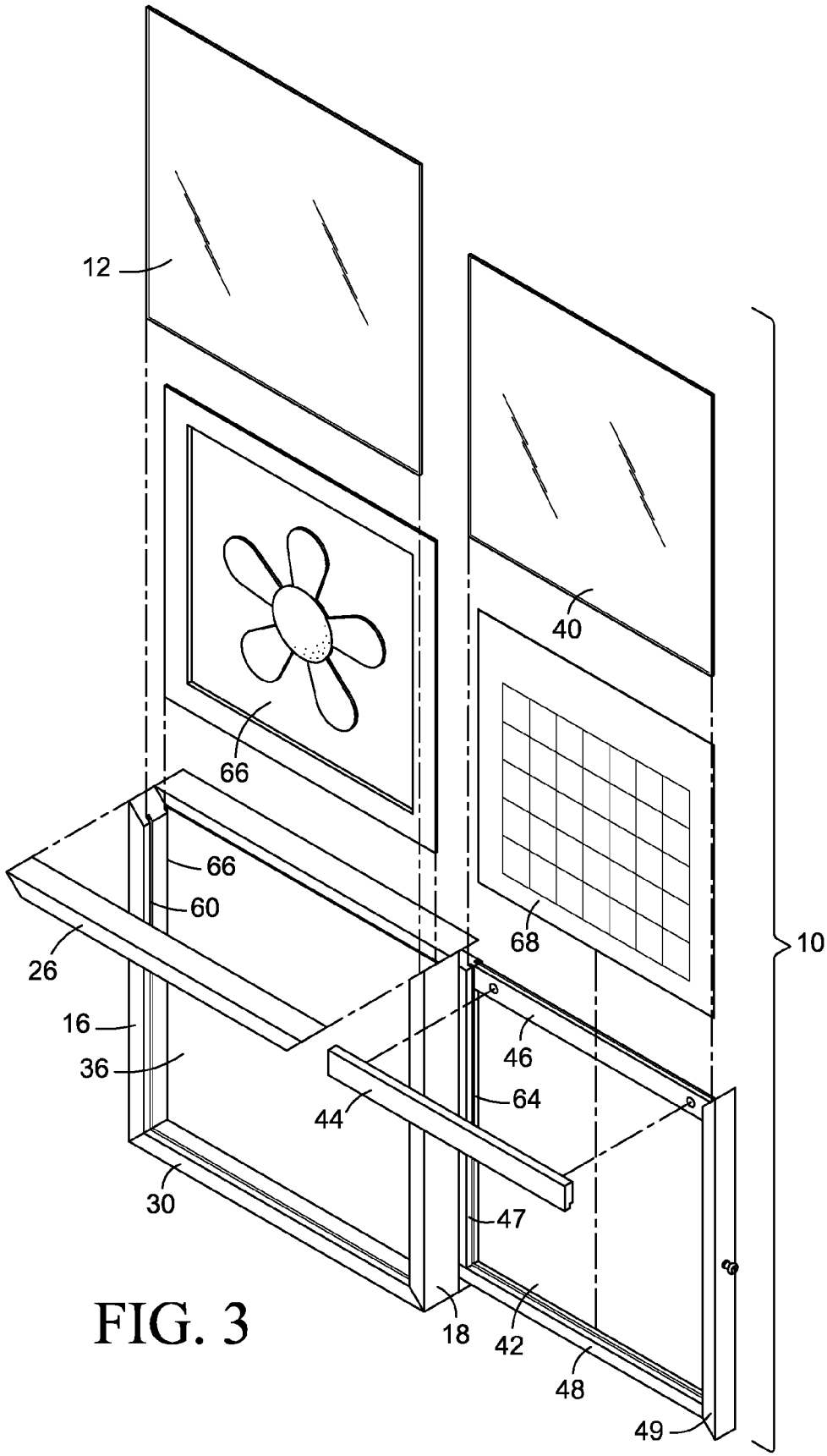
FIG. 3 is an exploded view of an embodiment of the shadow box and insert with the insert extended away from the box and with the top member of the box detached from the box. The top member of the insert is also removed from the insert. The front transparent member of both the shadow box and the insert are detached and extended away from both the shadow box and the insert. Additionally a piece of artwork for displaying in the shadow box as well as a calendar for displaying in the insert is shown.

FIG. 3 represents an exploded view of the shadow box and insert. The shadow box and insert 10 is shown with the insert 38 extended away from the shadow box 10. Additionally, the front member 26 of the top of the box 24 as well as the insert top first member 44 are removed. In this manner both the front 12 of the box 10 as well as the front 40 of the insert 38 can be removed upwardly from the box 10 and insert 38 as depicted in FIG. 3. Subsequently art 66 for the shadow box 10 and art 68 for the insert 38 can be inserted into either the first chamber 32 of the shadow box 10 or the insert chamber 39.

Figure 4:
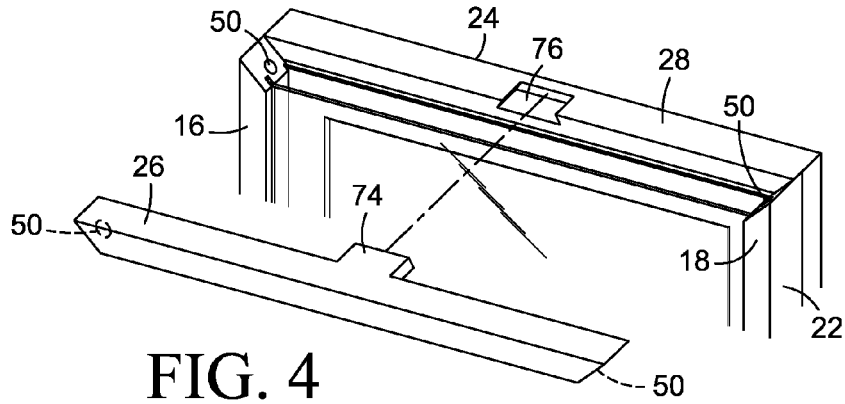
FIG. 4 illustrates an embodiment of the invention with the front member of the top of the shadow box detached to illustrate one embodiment of a connection means comprising a mechanical means for attaching the top of the shadow box to the shadow box. The mechanical means in this embodiment comprises a dovetail pin and a tail.

FIG. 4 illustrates one embodiment of a connector means 50 for connecting the top of the shadow box 24 to the shadow box 10. Similar means can also be used for attaching the top 44 of the insert 38 to the insert 38. In the illustrated embodiment mechanical means 74, 76 are provided for connecting the top of the box 26 to the first and second side walls 20, 22 of the box 10. The mechanical means in this embodiment comprise a dovetail pin 74 and dovetail pin receptacle 76.

Figure 5:
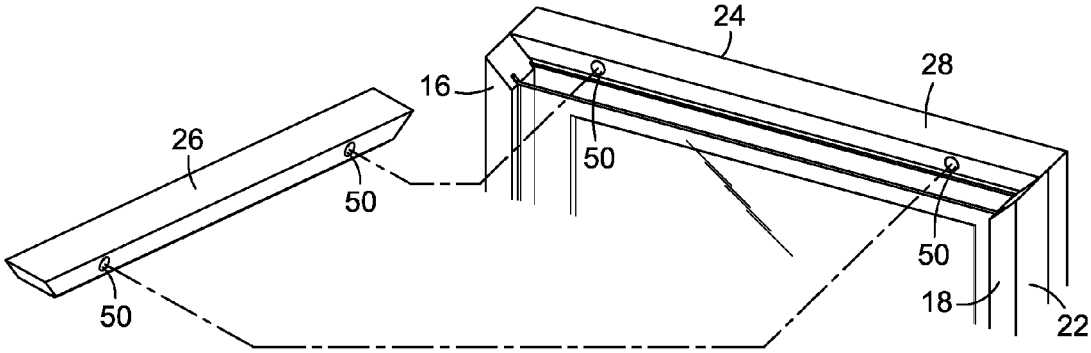
FIG. 5 illustrates an embodiment of the invention with the front member of the top of the shadow box detached to illustrate an embodiment of a connection means comprising a magnetic means for attaching the top of the shadow box to the shadow box.

FIG. 5 illustrates a magnetic means 50 for attaching the first member 26 of the top of the box 10 to the second member 28 of the top of the box 10. This is an alternative embodiment for a means for attaching the top of the box to the box 10. Additionally, this means can comprise numerous other attachment means know in the art. These attachment means can include mechanical means including but not limited to a dovetail system, a tenon and mortice system, etc. Furthermore, the attachment means can comprise a magnetic means in an embodiment comprising a magnet and a piece of metal are inserted one to a first member of the top of the box and the other to the second member of the top of the box. In this way the top of the box is held in place.

Figure 6:
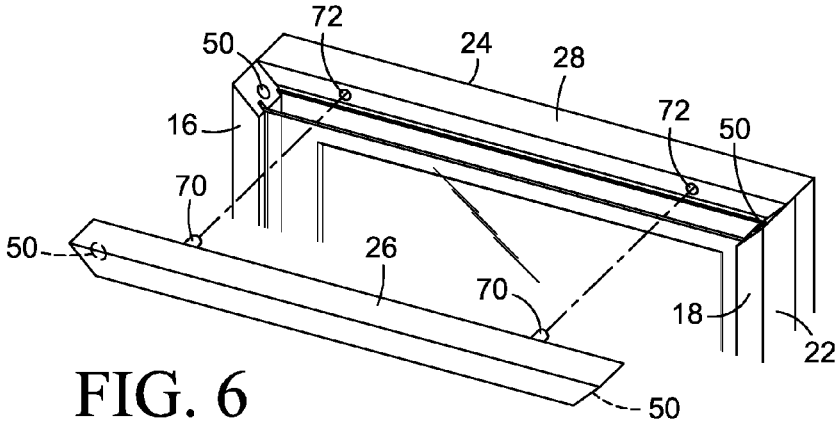
FIG. 6 illustrates an embodiment of the invention with the front member of the top of the shadow box detached to illustrate an embodiment of a connection means comprising a mechanical means of a mortise and tenon as well as a magnetic means of connecting the front member of the top of the shadow box to the shadow box.

FIG. 6 also presents another embodiment of a connecting means for attaching the top 24 of the shadow box 10 to the shadow box 10 comprising a mechanical system. In this illustration a tenon 70 is placed in the front member 26 of the top 24 of the box 10. In the second member 28 of the top 24 of the box 10 there is a mortise 72 in which the tenon 70 fits. Additionally, in this embodiment magnets, 50 are placed on the mitered ends of the top 24 of the box 10 as well as the mitered ends of the first side wall 16 and the second sidewall 22 of the box. This serves to further reinforce the attachment of the top 24 of the box 10 to the box 10.

Figure 7:
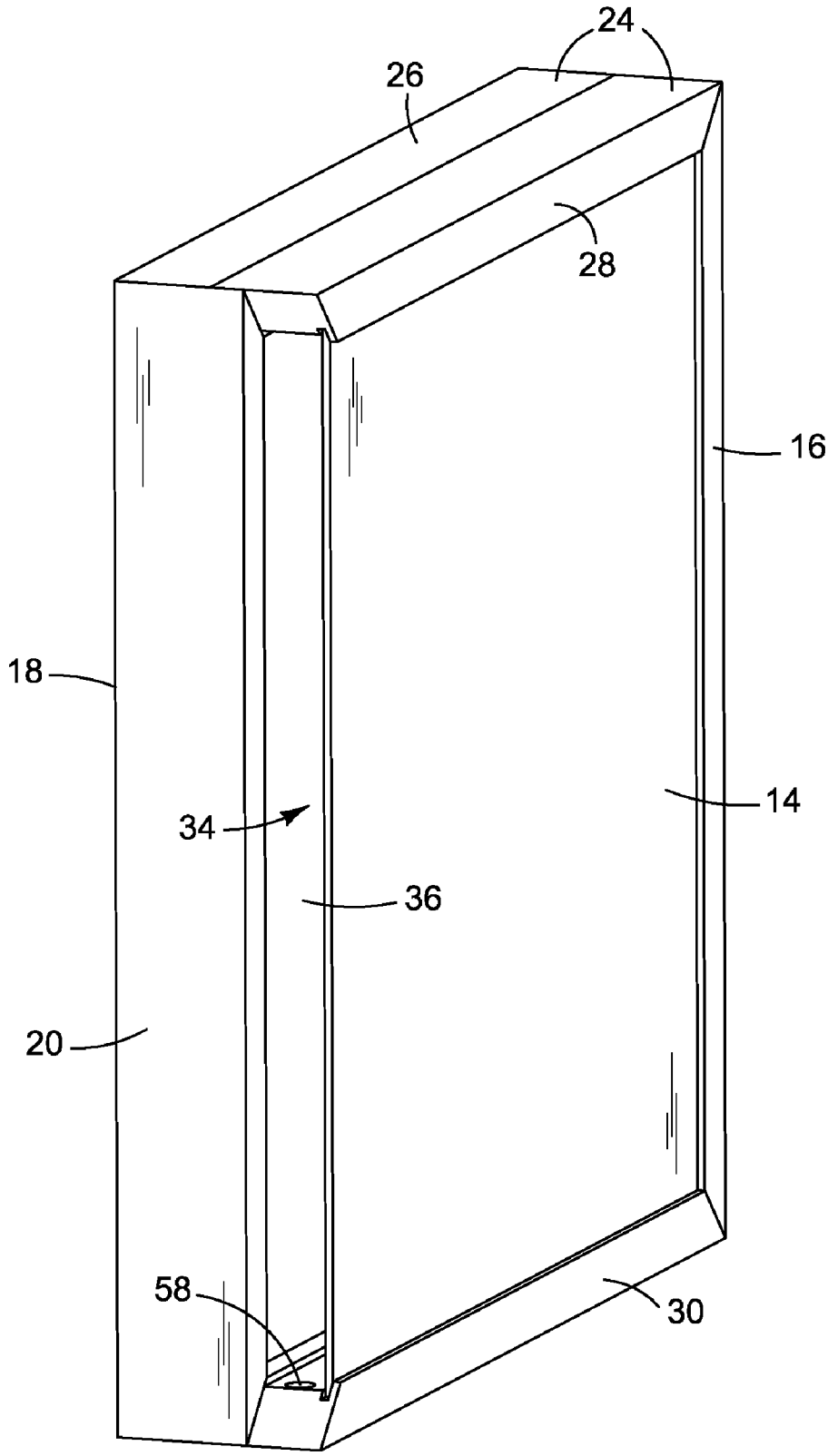
FIG. 7 is a perspective view of an embodiment of the shadow box with the insert removed from the second chamber to illustrate the magnetic means for holding the insert within the second chamber of the shadow box.

FIG. 7 illustrates the shadow box 10 with the insert 38 completely removed. This embodiment illustrates the connection means 58 at the bottom of the second chamber of the box. In this embodiment, magnets placed on the bottom of the insert corresponding to magnets placed in the second chamber of the shadow box can serve to both hold the insert 38 within the box 10 as well as to prevent the insert 38 from sagging when it is extended from the box 10.

Figure 10:
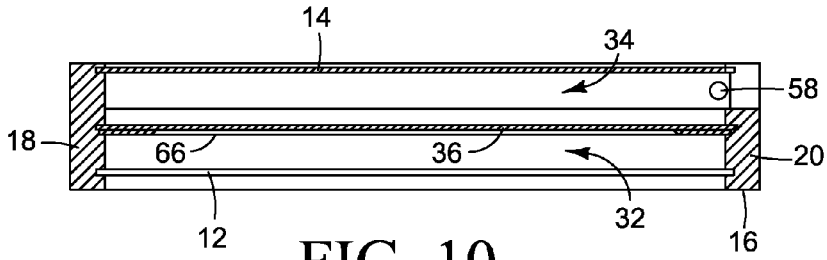
FIG. 10 is a cross section along the horizontal plane 10 as depicted in FIG. 8.
Figure 8:
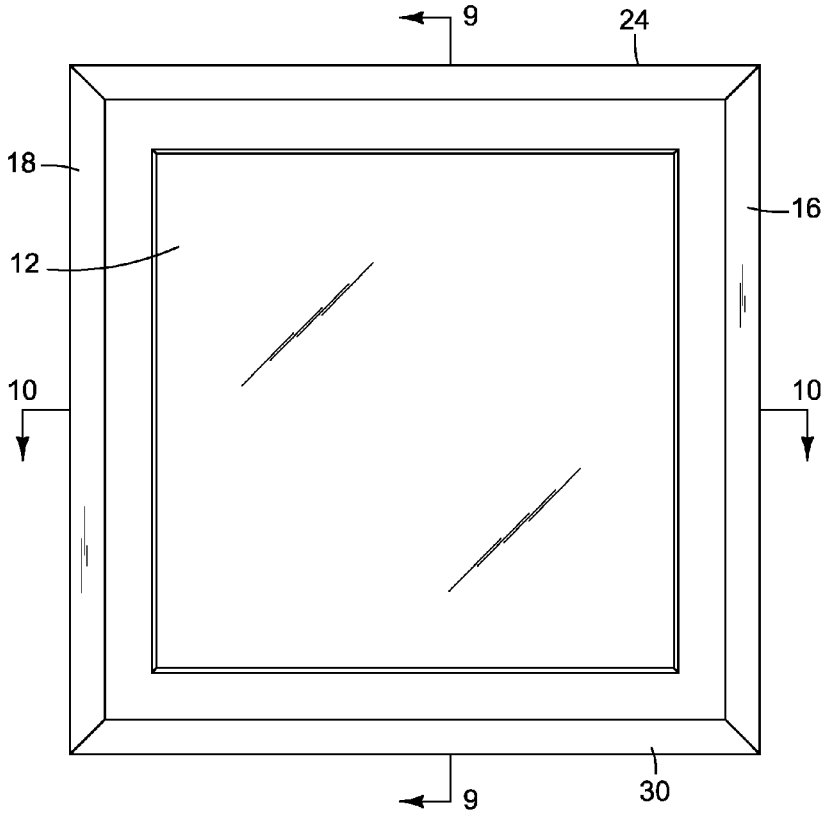
FIG. 8 is a front view of an embodiment of the shadow box illustrating two cross sections along vertical plane 9 and horizontal plane 10 for depiction in FIGS. 9 and 10.
Figure 9:
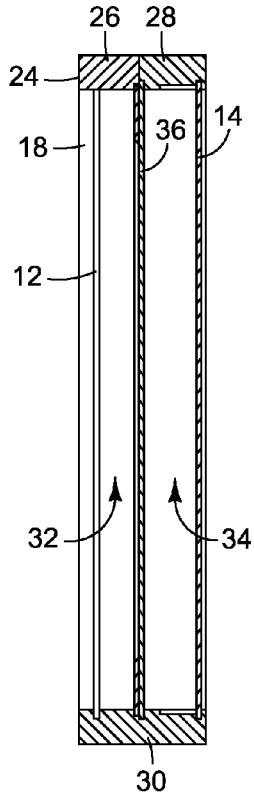
FIG. 9 is a cross section along the vertical plane 9 as depicted in FIG. 8.

FIG. 8 illustrates a front view of the shadow box 10. FIGS. 9 and 10 represent cross sections along broken lines 9 and 10 respectively of FIG. 8.

FIG. 9 illustrates a vertical cross section of the shadow box to illustrate both the first chamber 32 and the second chamber 34 of the shadow box. Additionally, the dividing partition 36 between the first chamber 32 and the second chamber 34 of the box 10 is also illustrated.

FIG. 10 illustrates a horizontal cross section of the shadow box with insert. In FIG. 10 both the front compartment 32 and the back compartment 34 are illustrated. Additionally the partition 36 between the compartments 32, 34 is also illustrated. In this view, a piece of art 66 is attached to the partition 36 on the side of the front chamber 32 to be viewed through the transparent front 12 of the front chamber 32. The partition 36 can comprise a wide variety of materials including a material configured for mounting objects for display on. In FIG. 10, a connecting means 58 comprising a magnetic means 58 is illustrated for holding the insert 38 in place either while extended or while contained within the second chamber 34 of the box 10. Although one magnetic means 50 is shown, numerous magnetic means or other connective means can be used within the box in order to either hold the insert within the shadow box 10 or to hold the insert at an extended position out from the shadow box 10. In this view it is apparent that grooves 60, 62 are in place to hold the front 12 of the box 10 in place as well as to hold the partition 36 between the front chamber 32 and the second chamber 34 of the shadow box 10 in place.

Figure 11:
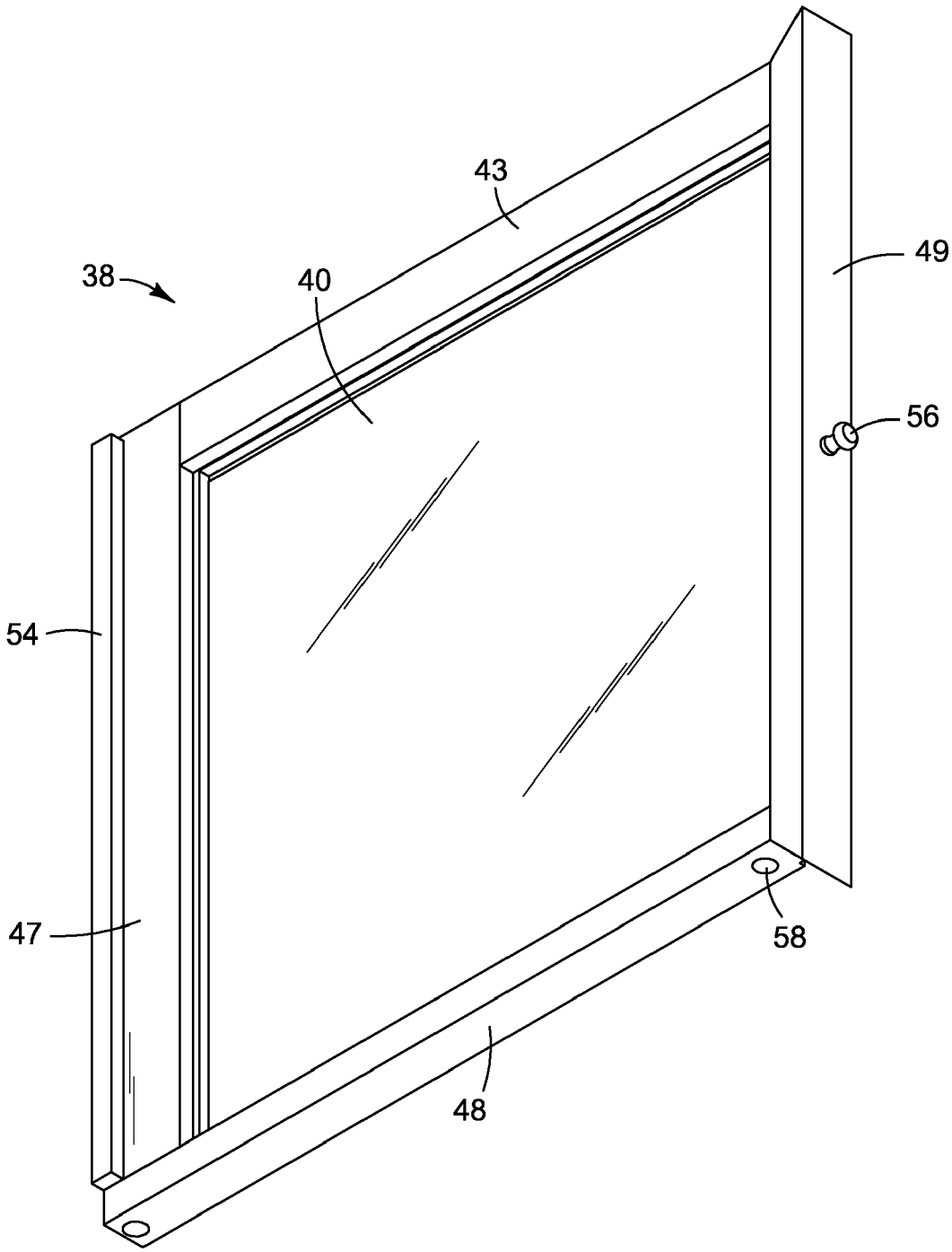
FIG. 11 is an elevation view of the insert detached from the shadow box for illustrating the L shaped extension of the insert.

FIG. 11 represents the insert 38 extended from the box 10. In this view it is illustrated that the insert 38 can have an L shape in this embodiment. The extension 54 prevents the insert 38 from being completely extended away from the box 10. Additionally magnetic means 58 can be seen at the bottom of the insert 38 in order to prevent the insert 38 from falling out of the shadow box 10 and also from sagging while being fully extended from the shadow box 10.

Figure 14:
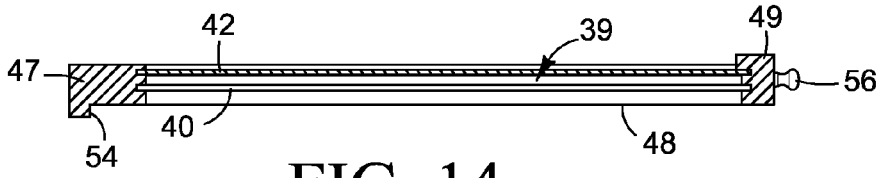
FIG. 14 is a cross-sectional view along horizontal plane 14 of FIG. 12.
Figure 13:
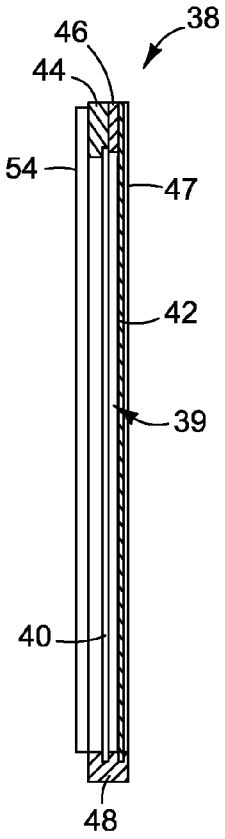
FIG. 13 is a cross sectional view along vertical plane 13 of FIG. 12.
Figure 12:
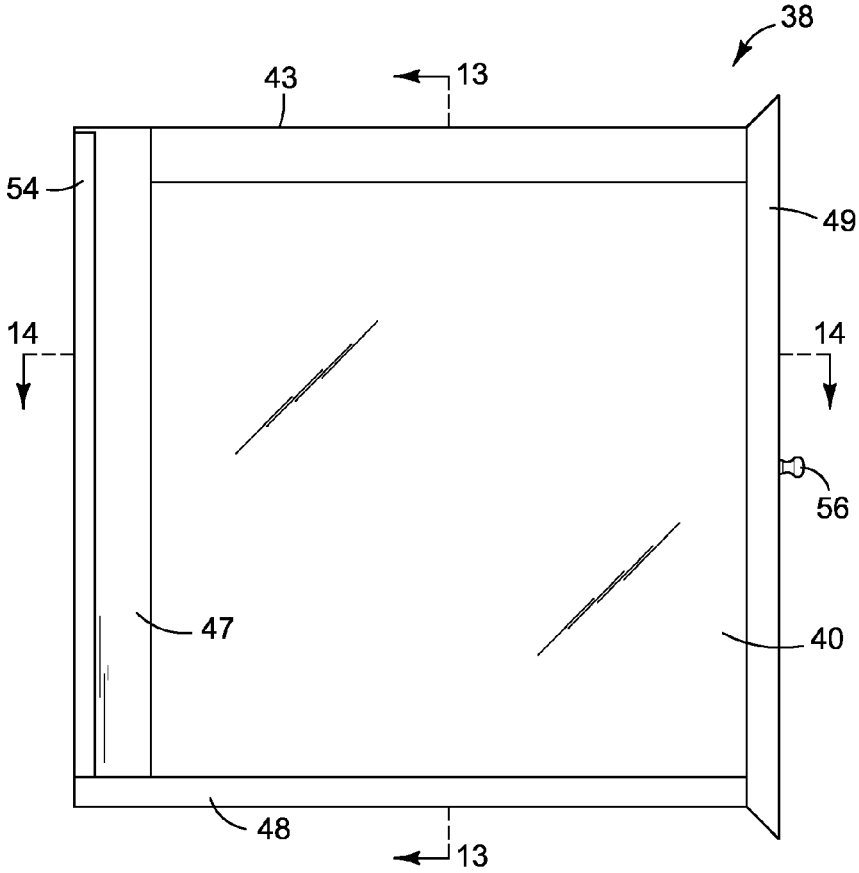
FIG. 12 is a front view of an embodiment of the insert removed from the shadow box. This view illustrates a horizontal plane and vertical plane for cross sectional views in FIG. 13 and FIG. 14.

FIG. 12 represents the insert 38 detached from the shadow box 10. FIGS. 13 and 14 represent cross sections along lines 13 and 14 of FIG. 12. In this view an embodiment can be seen in which the insert 38 comprises an L shape to prevent the insert 38 from being completely removed from the second chamber 34 of the shadow box. It can also be seen that there are grooves 64, 65 provided within the insert 38 for placing both the front 40 of the insert 38 as well as a display material to mount objects on within the insert 38. Although the insert 38 can be a used for mounting generally a variety of objects, in a preferred embodiment a calendar fits ideally within the insert.

Figure 15:
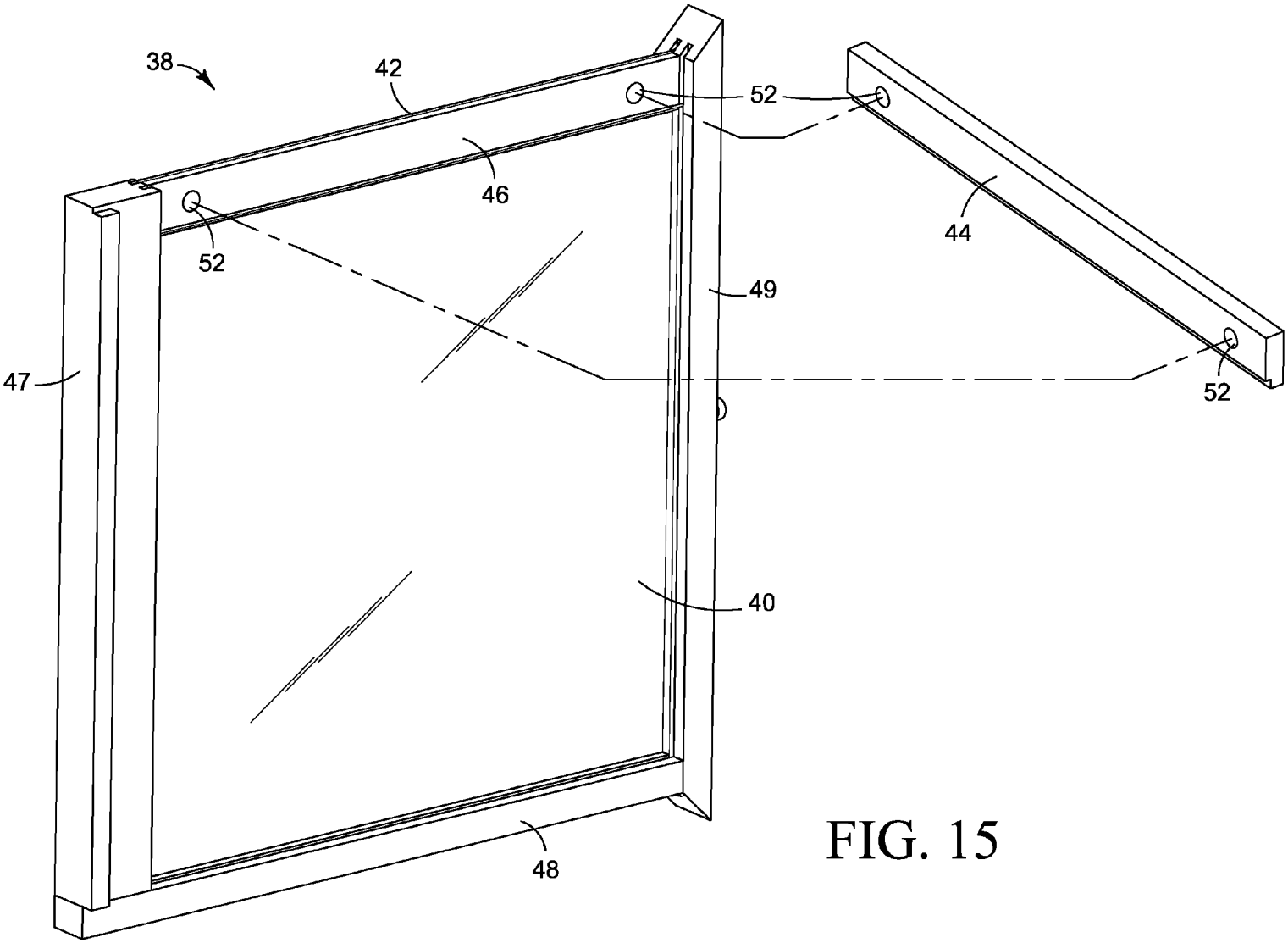
FIG. 15 is a perspective view of an embodiment of the insert with the top member detached in order to show an embodiment of the attachment means for attaching the top of the insert to the insert.

FIG. 15 illustrates the detachable top section 43 of the insert 38. The top of the insert 38 can comprise either one member or more than one member in other embodiments. In the depicted embodiment, there is a front member 44 and a back member 46. In this embodiment, the front member 44 has a magnetic means 52 that connects to a second half of the magnetic means 52 in the second member 46 of the top of the insert 38. In this way the top 43 of the insert 38 is configured such that the top 43 or front member 44 of the top 43 do not fall off without the application of force from a user to remove the top 43 of the box 10. In this way the front 40 of the insert 38 can be removed from the insert 38 by removing the top 43 of the insert 38 and sliding the front 40 of the insert 38 up and out of the insert 38 through the grooves 64 provided for holding the front 40 of the insert 38.

Figure 16:
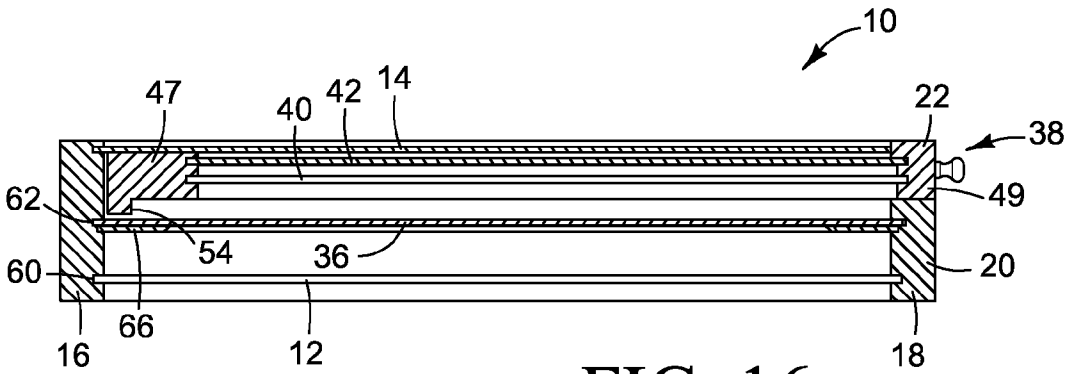
FIG. 16 is a horizontal cross-section of an embodiment of the shadow box and insert with the insert in the shadow box.
Figure 17:
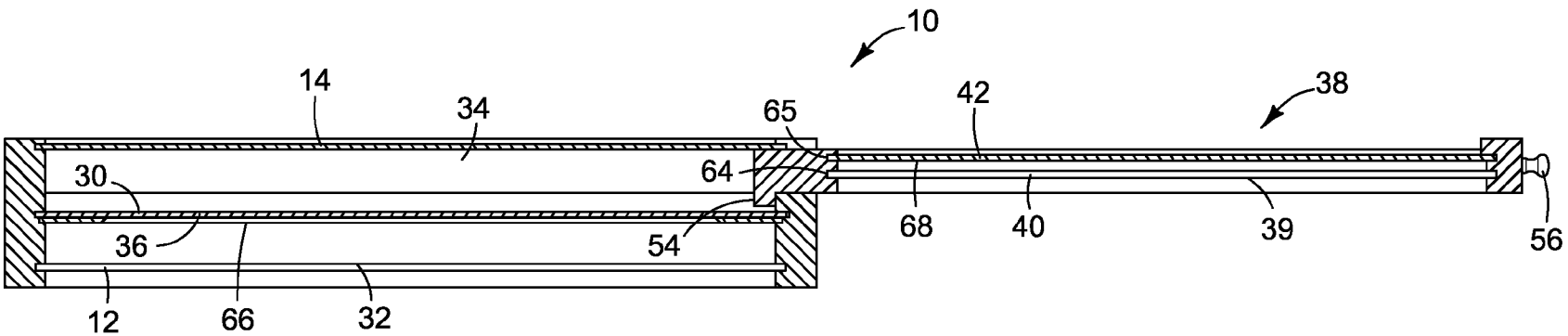
FIG. 17 is a cross-sectional view of an embodiment of the invention along a horizontal cross-section of the shadow box with the insert fully extended.

FIG. 16 represents a horizontal cross section of the shadow box 10 with the insert 38 in the shadow box second chamber 34. This insert 38 has an L shaped cross section. In this manner, the extension 54 of the L shape prevents the insert 38 from extending completely out of the box 10 as shown in FIG. 17. The insert 38 can still be removed by a user by pulling the insert out and moving the knob towards the front of the display case 10.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

The invention claimed is:

1. A shadow box and insert, wherein said shadow box and insert comprises:

a shadow box configured to display art objects, said shadow box comprising a top, a bottom, a front, a back, a first sidewall, and a second sidewall, wherein said shadow box comprises at least two chambers, at least one of said chambers comprising a front chamber and at least one of said chambers comprising a back chamber, wherein said front chamber is configured to display art objects, wherein said back chamber is configured to house an insert, wherein said shadow box is partitioned at least along a generally vertical plane from said first sidewall of said shadow box to said second sidewall of said shadow box to form said front chamber of said shadow box and said back chamber of said shadow box, wherein said front side of said shadow box is configured to be removably attached to said shadow box to facilitate access to said front chamber, wherein said front side of said shadow box comprises at least one section, wherein at least one of said sections of said front side of said shadow box comprises a transparent material, wherein said second sidewall of said shadow box comprises at least two members; and wherein said insert is configured to display art objects, said insert comprising a chamber formed by said insert having a top, a bottom, a front side, a back side, a first sidewall and a second sidewall, wherein said front side of said insert comprises at least one section, wherein at least one section of said front side of said insert comprises a transparent material, wherein said second sidewall of said insert comprises at least one of said members of said second sidewall of said shadow box, wherein said front side of said insert is configured to be removably attached to said shadow box to facilitate access to said front chamber, and wherein said insert is configured to slide into said back chamber of said shadow box and out of said back chamber of said shadow box.

2. The shadow box and insert of claim 1, wherein said shadow box and insert is configured to be mounted on a wall.

3. The shadow box and insert of claim 1, wherein said partition dividing said front chamber of said shadow box and said back chamber of said shadow box further comprises a material configured for mounting objects on.

4. The shadow box and insert of claim 1, wherein:

said top of said shadow box comprises at least one shadow box top member, wherein said top of said insert comprises at least one insert top member, wherein at least one of said shadow box top members is configured to be removably attached to said shadow box such that when one of said shadow box top members is removed said front of said shadow box is configured to be removed or at least one of said insert top members is configured to be removably attached to said insert such that when one of said insert top members is removed said front of said insert is configured to be removed.

5. The shadow box and insert of claim 4, wherein:

said top of said shadow box further comprises at least a shadow box top front member and a shadow box top back member, wherein said top of said insert comprises at least an insert top front member and an insert top back member, wherein at least one of said shadow box top front member or said insert top front member is removably configured to secure said front side of said shadow box to said shadow box or to secure said front side of said insert to said insert.

6. The shadow box and insert of claim 4, wherein said shadow box and insert further comprises at least one of a means to removably secure said shadow box top front member to said shadow box or a means to removably secure said insert top front member to said insert.

7. The shadow box and insert of claim 6, wherein at least one of said means to removably secure said shadow box top front member to said shadow box or said means to removably secure said insert top front member to said insert further comprise at least a magnetic means.

8. The shadow box and insert of claim 6, wherein at least one of said means to removably secure said shadow box top front member to said shadow box or said means to removably secure said insert top front member to said insert further comprise at least a mechanical means.

9. The shadow box and insert of claim 4, wherein said top, said bottom, said first sidewall and said second sidewall of said shadow box are connected by miter joints wherein said top and said bottom are connected to each of said sidewalls.

10. The shadow box and insert of claim 1 wherein at least one of said shadow box or said insert has grooves on an interior of said shadow box or an interior of said insert, said grooves configured for holding said front of said shadow box in place or for holding said front of said insert in place.

11. The shadow box and insert of claim 1, wherein said shadow box further comprises a means to prevent said insert from sliding completely out of said shadow box.

12. A shadow box and insert, wherein said comprises:

a shadow box, said shadow box comprising a frame having a top, a bottom, a front, a back, a first sidewall, and a second sidewall, wherein said shadow box comprises at least two chambers;

wherein at least one of said chambers comprises a front chamber and at least one of said chambers comprises a back chamber, wherein said front chamber is configured for displaying items, wherein said back chamber is configured to house an insert, wherein said shadow box is partitioned at least along a generally vertical plane from said first sidewall of said shadow box to said second sidewall of said shadow box to form said at least two chambers, wherein said second sidewall of said shadow box is divided along a vertical plane into two sections, a first section forming a sidewall of said front chamber and a second section forming a sidewall of said back chamber;

wherein said front of said shadow box comprises at least one section, at least one of said sections of said front of said shadow box comprises a transparent material, wherein said top of said shadow box comprises at least two shadow box top members, said at least two shadow box top members comprising a shadow box top front member and a shadow box top back member, wherein said shadow box top front member is removably attached to said shadow box, wherein said shadow box is configured such that said shadow box front side is removably attached to said shadow box such that when said shadow box top front member is removed from said shadow box said front of said shadow box is configured to be removable to facilitate access to said first chamber of said shadow box;

an insert configured to be housed in said back chamber of said shadow box, wherein said insert comprises a top, a bottom, a front side, a back side, a first sidewall and a second sidewall, wherein said second sidewall of said insert comprises said second section of said sidewall of said shadow box, wherein said insert is configured to extend out of said back chamber of said shadow box and into said back chamber of said shadow box, wherein said front of said insert comprises at least one section, wherein at least one of said sections of said front of said insert comprises a section comprising a transparent material, wherein said top of said insert comprises at least one member, wherein at least one member of said top of said insert is removably attached to said insert to facilitate access to an interior chamber of said insert, wherein said insert is configured for displaying items, wherein said insert is configured to slide into said second chamber and out of said second chamber of said shadow box;

a means to removably secure said shadow box top front member to said shadow box; and a means to removably secure said insert top member to said insert.

13. The shadow box and insert of claim 12, wherein at least one of said means to removably secure said shadow box top front member to said shadow box or said means to removably secure said top member of said insert of said shadow box to said insert further comprises a magnetic system.

14. The shadow box and insert of claim 12, wherein at least one of said means to removably secure said shadow box top front member to said shadow box or said means to removably secure said top member of said insert of said shadow box to said insert further comprises a mechanical system.

15. The shadow box and insert of claim 12, wherein at least one of an interior of said front chamber of said shadow box or an interior of said chamber of said insert has grooves configured for inserting and holding said front side of said shadow box as said front side of said shadow box or said front side of said insert as said front side of said insert.

16. The shadow box and insert of claim 12 wherein said shadow box is configured for mounting on a wall.

17. The shadow box and insert of claim 12, wherein said insert is configured to extend out of said shadow box such that said insert is prevented from extending completely out of said shadow box.

18. The shadow box and insert of claim 17, wherein said insert is configured as a generally L shaped structure, wherein said L-shaped structure is configured such that said L shaped structure prevents said insert from being extended fully out of said shadow box.

19. The shadow box and insert of claim 17 wherein an interior of said back chamber of said insert has a magnetic means configured for preventing said insert from being extended fully out of said shadow box.

20. A shadow box and insert, said shadow box and insert comprising:

a shadow box for displaying objects, said shadow box configured to be mounted on a wall, said shadow box having a front and a back, a top and a bottom, a first sidewall and a second sidewall, wherein said second sidewall comprises at least two pieces, wherein said shadow box comprises a front chamber and a back chamber, said chambers divided by a generally vertical partition extending from said first side of said shadow box to said second side of said shadow box, wherein said front chamber is configured to display art objects, wherein said back chamber is configured to house an insert, wherein said front of said shadow box comprises a transparent material;

wherein said top of said shadow box comprises at least two members, said at least two members of said top of said shadow box comprising at least a first member and a second member, wherein said first member of said top of said shadow box is configured to removably hold said front of said shadow box in place, wherein said front of said shadow box is configured to fit into at least one groove on an interior of said first chamber of said shadow box;

wherein said insert comprises a front and a back, a top and a bottom, a first side and a second side, wherein said second side of said insert is formed as one of said members of said second side of said shadow box, wherein said front of said insert comprises at least one member, wherein at least one member of said front of said insert comprises a transparent material, wherein said insert is configured to display art objects, wherein said insert is configured to slide into and out of said back chamber of said shadow box in order to display art objects within said insert, wherein said insert comprises a generally L shape such that said L shape prevents said insert from extending completely out of said back compartment of said shadow box;

wherein said top of said insert of said shadow box comprises at least two members, said at least two members of said top of said insert comprise at least a first member and a second member, wherein said first member of said top of said insert is configured to removably hold said front of said insert in place, wherein said front of said insert is configured to slide into a plurality of groves on an interior of said insert;

at least one attachment device configured for removably attaching at least one of said first member of said top of said shadow box to said device or said first member of said top of said insert to said insert; and wherein said insert is configured in an L shape to prevent said insert from sliding fully out of said second chamber of said shadow box.

* * * * *